US006076228A

United States Patent [19]

Aiken

[11] Patent Number: 6,076,228

[45] Date of Patent: Jun. 20, 2000

[54] FLOOR CLEANER WITH VACUUM DRYER

[76] Inventor: Michael D. Aiken, 2901 Roundtable Ct., Charleston, S.C. 29418

[21] Appl. No.: 09/109,694

[22] Filed: Jul. 2, 1998

[51] Int. Cl.[7] ..... A47L 7/00; A47L 5/34

[52] U.S. Cl. ..... 15/320; 15/339; 15/373

[58] Field of Search ..... 15/320, 339, 353, 15/355, 373

[56] References Cited

U.S. PATENT DOCUMENTS

| | | | |
|---|---|---|---|
| 1,970,293 | 8/1934 | Fairfax | 15/373 |
| 3,150,394 | 9/1964 | Sauers | 15/50.3 |
| 3,460,184 | 8/1969 | Dyer | 15/320 |
| 3,699,607 | 10/1972 | Putt | 15/320 |
| 3,959,844 | 6/1976 | Cyphert | 15/320 |
| 4,073,031 | 2/1978 | Schwartz | 15/373 |
| 4,109,342 | 8/1978 | Vermillion | 15/373 |
| 4,245,371 | 1/1981 | Satterfield | 15/320 |
| 4,393,537 | 7/1983 | Reprogle et al. | 15/373 |
| 4,446,595 | 5/1984 | Nakada et al. | 15/373 |
| 4,759,094 | 7/1988 | Palmer et al. | 15/353 |
| 5,133,107 | 7/1992 | MacDonald | 15/320 |
| 5,383,251 | 1/1995 | Whitaker et al. | 15/320 |
| 5,465,456 | 11/1995 | Fellhauer et al. | 15/320 |
| 5,813,086 | 9/1998 | Ueno et al. | 15/320 |

*Primary Examiner*—Theresa T. Snider

[57] ABSTRACT

A floor cleaner is provided including a housing having a grip extending from a top portion thereof for gripping purposes. Also included is a scrub assembly mounted on a bottom portion of the housing for cleaning a floor. Next provided is a vacuum port mounted on the bottom portion of the housing and connected to a recovery tank for suctioning water from the floor.

15 Claims, 2 Drawing Sheets

FIG. 3
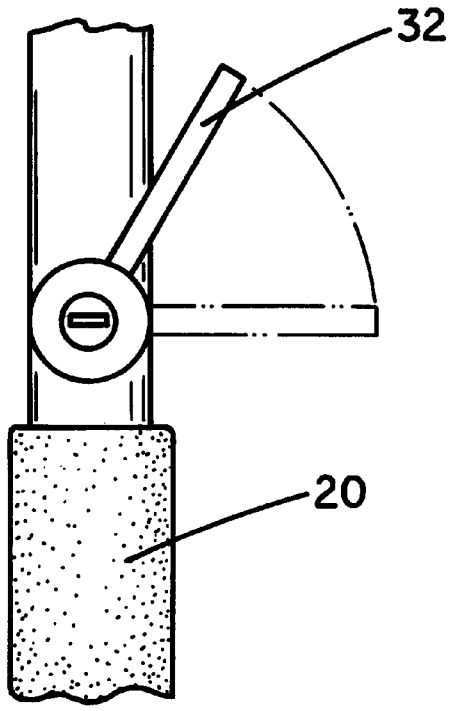
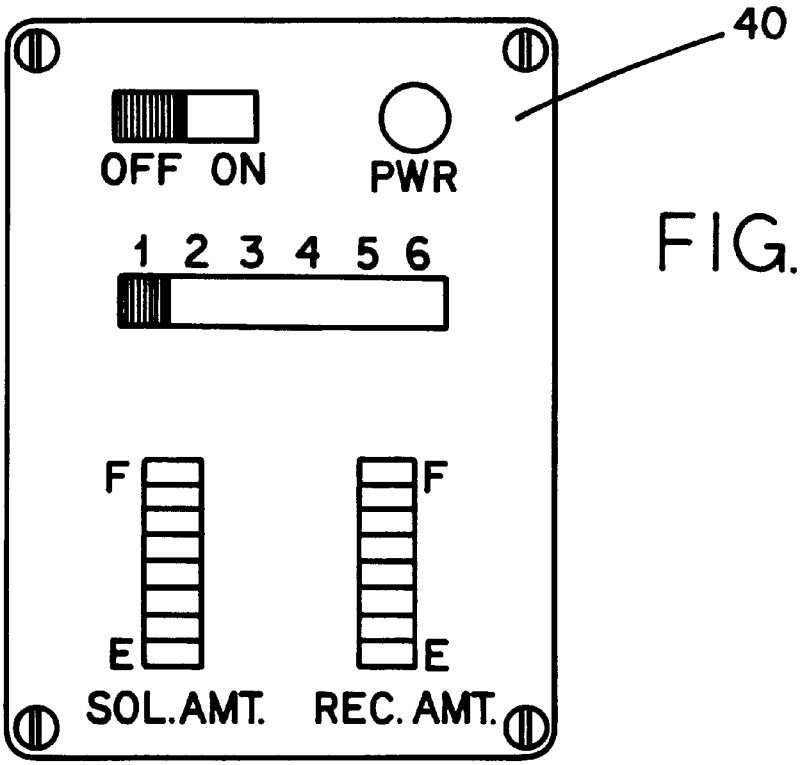
FIG. 4

FLOOR CLEANER WITH VACUUM DRYER

BACKGROUND OF THE INVENTION

1. Field of the Invention

The present invention relates to floor cleaners and more particularly pertains to a new floor cleaner with vacuum dryer for cleaning and drying a floor to prevent slip and fall accidents.

2. Description of the Prior Art

The use of floor cleaners is known in the prior art. More specifically, floor cleaners heretofore devised and utilized are known to consist basically of familiar, expected and obvious structural configurations, notwithstanding the myriad of designs encompassed by the crowded prior art which have been developed for the fulfillment of countless objectives and requirements.

Known prior art floor cleaners include U.S. Pat. No. 4,329,756; U.S. Pat. No. 4,397,057; U.S. Pat. Des. No. 298,479; U.S. Pat. No. 4,531,257; U.S. Pat. No. 4,123,818; and U.S. Pat. No. 4,809,396.

In these respects, the floor cleaner with vacuum dryer according to the present invention substantially departs from the conventional concepts and designs of the prior art, and in so doing provides an apparatus primarily developed for the purpose of cleaning and drying a floor to prevent slip and fall accidents.

SUMMARY OF THE INVENTION

In view of the foregoing disadvantages inherent in the known types of floor cleaners now present in the prior art, the present invention provides a new floor cleaner with vacuum dryer construction wherein the same can be utilized for cleaning and drying a floor to prevent slip and fall accidents.

The general purpose of the present invention, which will be described subsequently in greater detail, is to provide a new floor cleaner with vacuum dryer apparatus and method which has many of the advantages of the floor cleaners mentioned heretofore and many novel features that result in a new floor cleaner with vacuum dryer which is not anticipated, rendered obvious, suggested, or even implied by any of the prior art floor cleaners, either alone or in any combination thereof.

To attain this, the present invention generally comprises a housing having an intermediate portion with a constant rectangular horizontal cross-section along a height thereof. As shown in FIG. 1, the housing includes an angled front face, an angled rear face and a pair of angled side faces for defining an interior space. The housing further includes a bottom portion with a horizontally oriented bottom face having an area greater than that encompassed by the horizontal cross-section of the intermediate portion. A top portion of the housing is mounted on a top face of the intermediate portion and extends rearwardly therefrom. The top portion has at least one cylindrical grip coupled thereto which extends rearwardly therefrom for maintaining the housing in a generally upright orientation. The front face of the intermediate portion of the housing has a first compartment formed therein for containing a cleaning solution tank. For containing a recovery tank, the rear face of the intermediate portion of the housing has a second compartment formed therein. FIG. 1 shows a scrub assembly including a cylindrical brush. A pair of vertically oriented arms are rotatably coupled to opposite ends of the brush and extended upwardly therefrom. Such arms are in turn slidably coupled within a recess formed in the bottom face of the bottom portion of the housing. In addition, the scrub assembly includes a toggle switch mounted on an inboard end of the grip of the housing. In use, the toggle switch has a first orientation for lowering the cylindrical brush from the associated recess such that the same may be rolled about a floor to be cleaned. In a second orientation, the toggle switch is adapted for raising the cylindrical brush within the associated recess such that the same is stored therein. Next included is a water sprayer mounted on the bottom face of the bottom portion of the housing in front of the cylindrical brush of the scrub assembly. The water sprayer is connected to the cleaning solution tank for dispensing water downwardly and forwardly toward the floor at various pressures upon the actuation thereof. Mounted on the bottom face of the bottom portion of the housing to the rear of the cylindrical brush of the scrub assembly is a vacuum port. The vacuum port is connected to the recovery tank for suctioning water from the floor upon the actuation thereof. Associated therewith is a spherical ball rotatably mounted on the bottom face of the bottom portion of the housing between the vacuum port and the scrub assembly. The spherical ball serves for maintaining the vacuum port a slight predetermined distance from the floor when the cylindrical brush is situated within the recess of the housing. Finally, an indicator panel is coupled to the inboard end of the grip for indicating a current level of fluid within the tanks. It should be noted that the indicator panel further includes controls for allowing control of the pressure at which the water is dispensed by the water sprayer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new floor cleaner with vacuum dryer apparatus and method which has many of the advantages of the floor cleaners mentioned heretofore and many novel features that result in a new floor cleaner with vacuum dryer which is not anticipated, rendered obvious, suggested, or even implied by any of the prior art floor cleaners, either alone or in any combination thereof.

It is another object of the present invention to provide a new floor cleaner with vacuum dryer which may be easily and efficiently manufactured and marketed.

It is a further object of the present invention to provide a new floor cleaner with vacuum dryer which is of a durable and reliable construction.

An even further object of the present invention is to provide a new floor cleaner with vacuum dryer which is susceptible of a low cost of manufacture with regard to both materials and labor, and which accordingly is then susceptible of low prices of sale to the consuming public, thereby making such floor cleaner with vacuum dryer economically available to the buying public.

Still yet another object of the present invention is to provide a new floor cleaner with vacuum dryer which provides in the apparatuses and methods of the prior art some of the advantages thereof, while simultaneously overcoming some of the disadvantages normally associated therewith.

Still another object of the present invention is to provide a new floor cleaner with vacuum dryer for cleaning and drying a floor to prevent slip and fall accidents.

Even still another object of the present invention is to provide a new floor cleaner with vacuum dryer that includes a housing having a grip extending from a top portion thereof for gripping purposes. Also included is a scrub assembly mounted on a bottom portion of the housing for cleaning a floor. Next provided is a vacuum port mounted on the bottom portion of the housing and connected to a recovery tank for suctioning water from the floor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a bottom view of the grip of the present invention showing the toggle switch associated with the scrub assembly.

FIG. 4 is a top view of the indicating panel of the present invention.

DESCRIPTION OF THE PREFERRED EMBODIMENT

Figure 1:
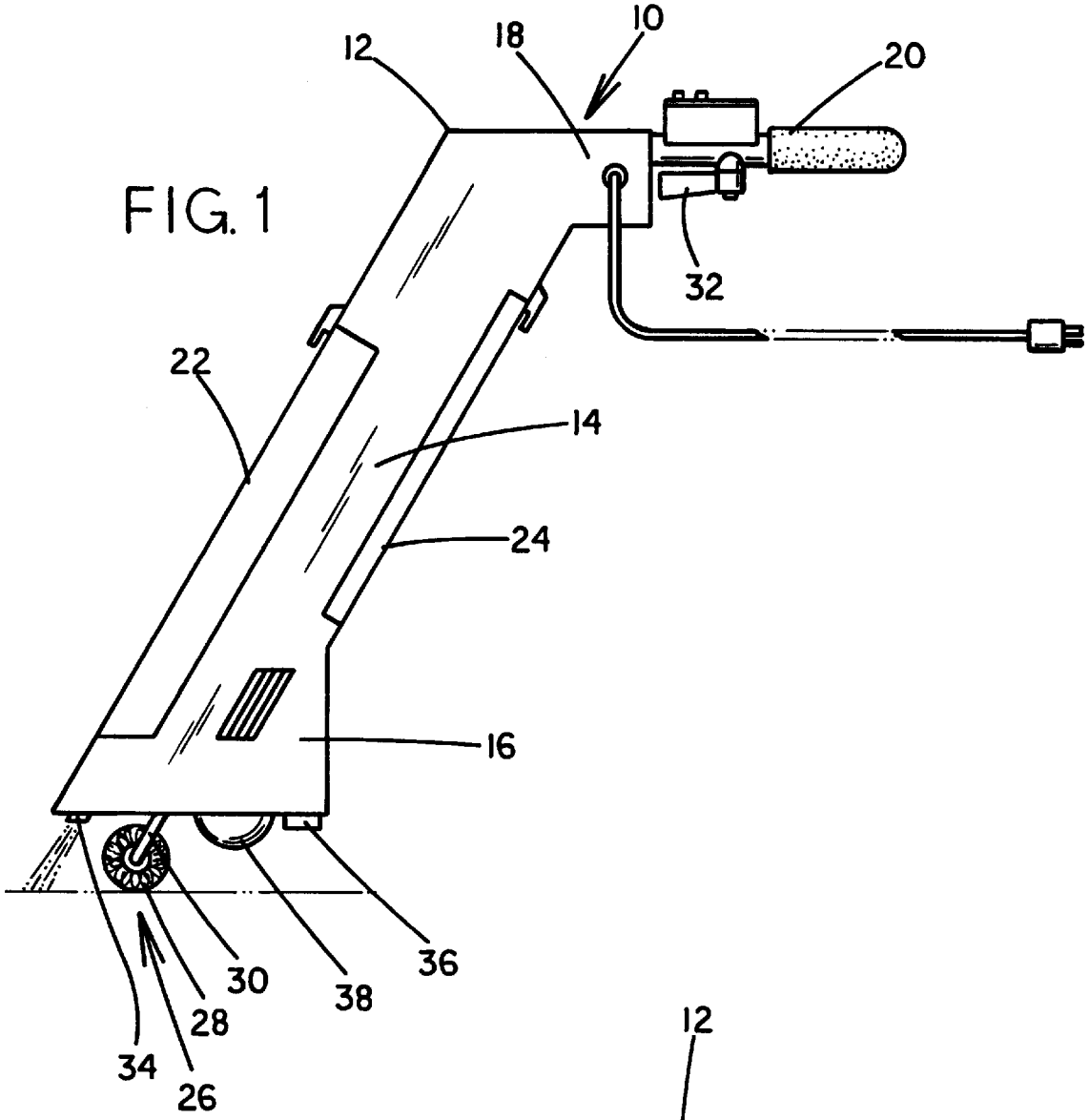
FIG. 1 is a side view of a new floor cleaner with vacuum dryer according to the present invention.

With reference now to the drawings, and in particular to FIGS. 1 through 4 thereof, a new floor cleaner with vacuum dryer embodying the principles and concepts of the present invention and generally designated by the reference numeral 10 will be described.

The present invention, designated as numeral 10, includes a housing 12 having an intermediate portion 14 with a constant rectangular horizontal cross-section along a height thereof. As shown in FIG. 1, the housing includes an angled front face, an angled rear face and a pair of angled side faces for defining an interior space. The housing further includes a bottom portion 16 with a beveled rear face which defines a horizontally oriented bottom face having an area greater than that encompassed by the horizontal cross-section of the intermediate portion. A top portion 18 of the housing is mounted on a top face of the intermediate portion and extends rearwardly therefrom.

The top portion has at least one cylindrical grip 20 coupled thereto which extends rearwardly therefrom for allowing a user to maintain the housing in a generally upright orientation. By the angled nature of the housing, a user may walk behind the housing while handling the grip and not strike his or her feet against the rear face. The front face of the intermediate portion of the housing has a first compartment 22 formed therein for containing a cleaning solution tank. For containing a recovery tank, the rear face of the intermediate portion of the housing has a second compartment 24 formed therein. It should be noted that the first and second compartments each have a lid snappily coupled thereon.

FIG. 1 shows a scrub assembly 26 including a cylindrical brush 28. Such cylindrical brush preferably has a length equal to a width of the bottom face of the bottom portion of the housing. Further, the cylindrical brush is ideally equipped with wool mop-like loops for absorbing liquid and scrubbing. A pair of vertically oriented arms 30 are rotatably coupled to opposite ends of the cylindrical brush and extend upwardly therefrom. It should be further noted that the cylindrical brush of the scrub assembly is mechanized in that it is rotated by way of a belt or chain. Such belt or chain is rotatably mounted about a central recessed portion of the cylindrical brush and a motor. In use, the arms, motor and belt are preferably mounted on a carriage which is slidably coupled within a recess formed in the bottom face of the bottom portion of the housing.

In addition, the scrub assembly includes a toggle switch 32 mounted on an inboard end of the grip of the housing. In use, the toggle switch has a first orientation for lowering the cylindrical brush and associated assembly from the associated recess such that the same may be rolled about a floor to be cleaned. In a second orientation, the toggle switch is adapted for raising the cylindrical brush and associated assembly within the associated recess such that the same is stored therein. It should be noted that the aforementioned carriage may be retracted and extended by way of a solenoid, motor or the like.

Next included is a water sprayer 34 mounted on the bottom face of the bottom portion of the housing in front of the cylindrical brush of the scrub assembly. The water sprayer is connected to the cleaning solution tank for dispensing water downwardly and forwardly toward the floor at various pressures upon the actuation thereof.

Mounted on the bottom face of the bottom portion of the housing to the rear of the cylindrical brush of the scrub assembly is a vacuum port 36 . The vacuum port is connected to the recovery tank for suctioning water from the floor and further storing the same in the recovery tank upon the actuation thereof. Like the scrub assembly, both the vacuum port and the water sprayer have a corresponding motor for effecting the appropriate operation of an associated pump. Vents are preferably formed on the intermediate portion of the housing for facilitating the cooling of such motors.

Figure 2:
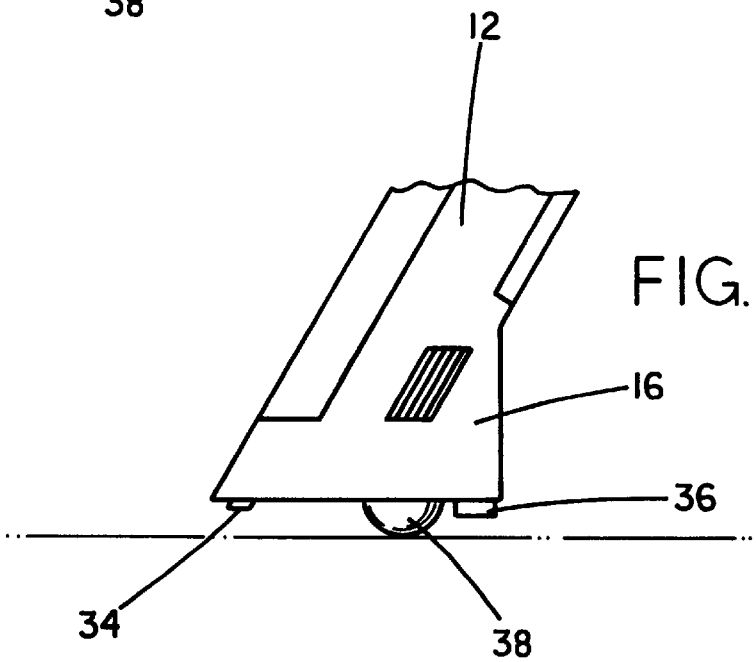
FIG. 2 is a side view of the present invention with the cylindrical brush of the scrub assembly in a retracted orientation.

As shown in FIG. 1 & 2, a spherical ball 38 is rotatably mounted on the bottom face of the bottom portion of the housing between the vacuum port and the scrub assembly. The spherical ball serves for maintaining the vacuum port a slight predetermined distance from the floor when the cylindrical brush is situated within the recess of the housing.

Finally, an indicator panel 40 is coupled to the inboard end of the grip for indicating a current level of fluid within the tanks. This may be accomplished by way of a floater indicator or the like. As shown in FIG. 4, the indicator panel preferably has a pair of LED gauges each showing what proportion of the corresponding tank is full. It should be noted that the indicator panel further includes a slider switch for allowing control of the pressure at which the water is dispensed by the water sprayer. A power switch and indicator light are also situated on the indicator panel. Controls for the actuation of the water sprayer and vacuum port may also be positioned on the indicator panel. As an option, various speed controllers may be incorporated to govern the speed of operation of the vacuum port and scrub assembly.

Optionally, the floor cleaner 10 may incorporate a rechargeable battery such that a power cord for the cleaner 10 is not required during use of the device. Further, an elongate extension wand (not shown) may be included with the cleaner, with the wand being adapted such that it is in communication with the water sprayer and the vacuum port of the cleaner 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A floor cleaner comprising, in combination:

a housing including an intermediate portion with a constant rectangular horizontal cross-section along a height thereof and including an angled front face, an angled rear face and a pair of angled side faces for defining an interior space, the housing further including a bottom portion with a horizontally oriented bottom face having an area greater than that encompassed by the horizontal cross-section of the intermediate portion and a top portion mounted on a top face of the intermediate portion and extending rearwardly therefrom, the top portion having at least one cylindrical grip coupled thereto and extending rearwardly therefrom for maintaining the housing in a generally upright orientation, the front face of the intermediate portion of the housing having a first compartment formed therein for containing a cleaning solution tank, the rear face of the intermediate portion of the housing having a second compartment formed therein for containing a recovery tank;

a scrub assembly including a cylindrical brush having a pair of vertically oriented arms rotatably coupled to opposite ends of the brush and extended upwardly therefrom for slidably coupling within a recess formed in the bottom face of the bottom portion of the housing, the scrub assembly further including a toggle switch mounted on an inboard end of the grip of the housing and having a first orientation for lowering the cylindrical brush from the associated recess such that the same may be rolled about a floor to be cleaned, the toggle switch further having a second orientation for raising the cylindrical brush within the associated recess such that the same is stored therein;

a water sprayer mounted on the bottom face of the bottom portion of the housing in front of the cylindrical brush of the scrub assembly and connected to the cleaning solution tank for dispensing water downwardly and forwardly toward the floor at various pressures upon the actuation thereof;

a vacuum port mounted on the bottom face of the bottom portion of the housing to the rear of the cylindrical brush of the scrub assembly and connected to the recovery tank for suctioning water from the floor upon the actuation thereof;

a spherical ball rotatably mounted on the bottom face of the bottom portion of the housing between the vacuum port and the scrub assembly for maintaining the vacuum port a slight predetermined distance from the floor when the cylindrical brush is situated within the recess of the housing; and an indicator panel coupled to the inboard end of the grip for indicating a current level of fluid within the tanks and further allowing control of the pressure at which the water is dispensed by the water sprayer.

2. A floor cleaner comprising:

a housing including a grip extending from a top portion thereof for gripping purposes;

a scrub assembly mounted on a bottom portion of the housing for cleaning a floor upon the actuation thereof; and a vacuum port mounted on the bottom portion of the housing and connected to a recovery tank for suctioning water from the floor upon the actuation thereof;

wherein the scrub assembly is retractable within the housing; and wherein a toggle switch is mounted on the housing for controlling the raising and lowering of the scrub assembly.

3. A floor cleaner as set forth in claim 2 wherein an intermediate portion of the housing is angled rearwardly from bottom to top.

4. A floor cleaner as set forth in claim 2 wherein a rolling means is mounted on the bottom portion of the housing for positioning the vacuum port at a slight predetermined elevation with respect to the floor upon the scrub assembly being fully raised.

5. A floor cleaner as set forth in claim 2 wherein the scrub assembly includes a rotatable cylindrical brush.

6. A floor cleaner as set forth in claim 2 wherein a cleaning solution tank is mounted on the housing and connected to a water sprayer on the housing for spraying water on the floor to be cleaned.

7. A floor cleaner as set forth in claim 6 and further including control means for controlling a pressure at which the water is dispensed by the water sprayer.

8. A floor cleaner as set forth in claim 2 and further including an indicator panel coupled to the inboard end of the grip for indicating a current level of fluid within the recovery tank.

9. A floor cleaner comprising:

a housing including a grip extending from a top portion thereof for gripping purposes;

a scrub assembly mounted on a bottom portion of the housing for cleaning a floor upon the actuation thereof; and a vacuum port mounted on the bottom portion of the housing and connected to a recovery tank for suctioning water from the floor upon the actuation thereof;

wherein the scrub assembly is retractable within the housing; and wherein a rolling means is mounted on the bottom portion of the housing for positioning the vacuum port at a slight predetermined elevation with respect to the floor upon the scrub assembly being fully raised.

10. A floor cleaner as set forth in claim 9 wherein an intermediate portion of the housing is angled rearwardly from bottom to top.

11. A floor cleaner as set forth in claim 9 wherein a rolling means is mounted on the bottom portion of the housing for positioning the vacuum port at a slight predetermined elevation with respect to the floor upon the scrub assembly being fully raised.

12. A floor cleaner as set forth in claim 9 wherein the scrub assembly includes a rotatable cylindrical brush.

13. A floor cleaner as set forth in claim 9 wherein a cleaning solution tank is mounted on the housing and connected to a water sprayer on the housing for spraying water on the floor to be cleaned.

14. A floor cleaner as set forth in claim 13 and further including control means for controlling a pressure at which the water is dispensed by the water sprayer.

15. A floor cleaner as set forth in claim 9 and further including an indicator panel coupled to the inboard end of the grip for indicating a current level of fluid within the recovery tank.

* * * * *